US006986559B1

(12) United States Patent
Youngberg et al.

(10) Patent No.: US 6,986,559 B1
(45) Date of Patent: Jan. 17, 2006

(54) POSITION INFORMATION APPARATUS AND METHODS FOR RADIAL PRINTING

(75) Inventors: Carl E. Youngberg, Mapleton, UT (US); George Lynn Bradshaw, Palo Alto, CA (US); Jan Eugene Unter, Alamo, CA (US); Randy Quinn Jones, Sunnyvale, CA (US)

(73) Assignee: Elesys, Inc., Sunnyvale, CA (US)

( * ) Notice: Subject to any disclaimer, the term of this patent is extended or adjusted under 35 U.S.C. 154(b) by 0 days.

(21) Appl. No.: 10/127,948

(22) Filed: Apr. 22, 2002

Related U.S. Application Data

(60) Provisional application No. 60/285,487, filed on Apr. 20, 2001.

(51) Int. Cl.
*B41J 3/00* (2006.01)

(52) U.S. Cl. ..... 347/2; 347/19

(58) Field of Classification Search ..... 347/2, 347/107, 19, 101; B41J 3/00, 29/393, 2/01
See application file for complete search history.

(56) References Cited

U.S. PATENT DOCUMENTS

| | | | | |
|---|---|---|---|---|
| 4,005,264 | A * | 1/1977 | Humbs et al. | 178/34 |
| 4,110,594 | A | 8/1978 | May | 291/121 |
| 4,228,396 | A * | 10/1980 | Palombo et al. | 324/163 |
| 4,255,061 | A * | 3/1981 | Beery | 400/124.07 |
| 4,556,966 | A | 12/1985 | Bricot et al. | 369/52 |
| 4,721,969 | A | 1/1988 | Asano | 346/157 |
| 4,739,415 | A | 4/1988 | Toyono et al. | 358/296 |
| 4,872,026 | A | 10/1989 | Rasmussen et al. | 346/140 |
| 5,041,846 | A | 8/1991 | Vincent et al. | 346/25 |
| 5,059,047 | A * | 10/1991 | Nakamura et al. | 400/322 |
| 5,115,250 | A | 5/1992 | Harmon et al. | 346/1.1 |
| 5,154,957 | A | 10/1992 | Yamada et al. | 428/64 |
| 5,317,337 | A | 5/1994 | Ewaldt | 346/1.1 |
| 5,395,181 | A * | 3/1995 | Dezse et al. | 400/103 |
| 5,444,687 | A | 8/1995 | Okumura | 369/50 |
| 5,468,076 | A | 11/1995 | Hirano et al. | 400/59 |
| 5,518,325 | A | 5/1996 | Kahle | |
| 5,597,590 | A | 1/1997 | Tanimoto et al. | 425/174.4 |
| 5,634,730 | A | 6/1997 | Bobry | 400/88 |
| 5,656,229 | A | 8/1997 | Tanimoto et al. | 264/400 |
| 5,918,540 | A * | 7/1999 | Fischer | 101/128.4 |
| 5,967,676 | A | 10/1999 | Cutler et al. | 400/70 |
| 6,019,151 | A | 2/2000 | Wen et al. | 156/387 |
| 6,202,550 | B1 | 3/2001 | Lee et al. | 101/38.1 |
| 6,264,295 | B1 | 7/2001 | Bradshaw et al. | 347/2 |
| 6,332,680 | B1 * | 12/2001 | Ozawa | 347/104 |
| 6,386,667 | B1 * | 5/2002 | Cariffe | 347/12 |

FOREIGN PATENT DOCUMENTS

| | | |
|---|---|---|
| EP | 0952725 A2 | 10/1999 |
| JP | 07101039 | 4/1995 |

(Continued)

*Primary Examiner*—Manish Shah
*Assistant Examiner*—Leonard Liang
(74) *Attorney, Agent, or Firm*—Beyer Weaver & Thomas LLP

(57) ABSTRACT

Methods and apparatus for determining angular position information and the printing of individual ink objects at target print sectors disbursed around an annular surface on a circular spinning media such as on a CD, dynamically during the radial printing process, are described. Mechanisms for computing the instantaneous angular position and apparatus for collocating encoder devices in close proximity to the CD rotation motor are disclosed.

21 Claims, 10 Drawing Sheets

FOREIGN PATENT DOCUMENTS

| | | | | |
|---|---|---|---|---|
| JP | 09265760 | | | 10/1997 |
| JP | 09306144 | A | | 11/1997 |
| JP | 2000040264 | A | * | 2/2000 |
| JP | 2001033275 | A | * | 2/2001 |
| WO | WO 8801114 | A1 | * | 2/1998 |
| WO | WO00/32399 | | | 6/2000 |

* cited by examiner

FIG. 2a, (section enlarged)

FIG. 3a, (section enlarged)

FIG. 4a, (section enlarged)

FIG. 5a, (section enlarged)

FIG. 6a, (section enlarged)

FIG. 7a, (section enlarged)

POSITION INFORMATION APPARATUS AND METHODS FOR RADIAL PRINTING

CROSS REFERENCE TO RELATED APPLICATIONS

This application claims priority to U.S. Provisional Patent Application, having application No. 60/285,487, filed Apr. 20, 2001, entitled POSITION INFORMATION METHODS FOR RADIAL PRINTING, by Carl E. Youngberg. This application also relates to U.S. Pat. No. 6,264,295, issued Jul. 24, 2001, entitled RADIAL PRINTING SYSTEM AND METHODS by George L. Bradshaw et al.; and also relates to co-pending U.S. Patent Application, having application Ser. No. 09/815,064, filed Mar. 21, 2001, entitled METHOD FOR PROVIDING ANGULAR POSITION INFORMATION FOR A RADIAL PRINTING SYSTEM, by Youngberg et al. These referenced applications are incorporated herein by reference in their entirety for all purposes.

FIELD OF THE INVENTION

The present invention relates to fluid dispensing devices and methods for printing on spinning circular media. More particularly, it concerns mechanisms for translating angular position and speed information of a rotating circular media discs.

BACKGROUND OF THE INVENTION

In the art of dispensing fluidic ink objects as it applies to radial printing, there is a need to place ink objects accurately and precisely onto the spinning circular media to effectively use the mechanisms of radial printing. Radial printing, as taught by Bradshaw et al., generally includes the process of dispensing ink onto a media at a particular radius of the media and a particular angular position while the media is rotating.

Radial printing places ink on a circular media as it is rotating. To properly place the ink, the electronics governing the print process must have as one of it's inputs information relating to the instantaneous position of the disk with respect to the print engine emitting the ink. That information over a period of time translates to instantaneous angular velocity, which affects other aspects of radial printing such as pen firing frequency. Thus, in any radial printing system, a method must be employed to provide the electronics governing the printing process with the position information.

In view of the foregoing, mechanisms for accurately providing angular position while on a spinning CD are needed.

SUMMARY OF THE INVENTION

Accordingly, mechanisms for translating angular position and speed information of a rotating media, such as a compact disc (CD), undergoing the process of decoration or labeling (radial printing) for facilitating accurate and repeatable ink placement are provided. As the media's instantaneous angular velocity changes, and especially at higher rotation speeds, ink placement accuracy requires instantaneous angular position information of the rotating media. Thus, mechanisms for providing instantaneous angular position information regarding the rotating media to the electronics governing the radial print process are disclosed. In a preferred implementation, the radial printing mechanisms is integrated with a compact disk recording (CD-R) device.

In one embodiment, an apparatus for interfacing with a media recording device to thereby print onto a rotating media is disclosed. The recording device includes a rotation motor control mechanism for rotating the media and an interface system for allowing control of the rotation motor control mechanism. The apparatus includes an encoder for sensing a substantially instantaneous angular position of the rotating media. The encoder is independent from the recording device. The apparatus further includes a radial print system for receiving the angular position from the encoder, interfacing with the interface system of the recording device to thereby control the rotation motor control mechanism, and dispensing ink onto the rotating media based on the received angular position.

In one aspect, the angular position sensed by the encoder is not sent to the recording device. In another aspect, the angular position sensed by the encoder is not obtained from an encoder of the recording device. In a specific implementation, the encoder is formed from a grating having a readable pattern and positioned to rotate with the media and a sensor positioned to sense the pattern of the grating to thereby obtain an angular position of the rotating media. In a further implementation, the encoder employs an optical or magnetic sensing technology.

In another implementation, the rotation motor control mechanism of the recording device includes a media hub on which the media is placed and rotated thereon. In this embodiment, the grating of the encoder is positioned on a side of the hub which is opposite a side on which the media is placed and sensor of the encoder is positioned proximate to the grating of the encoder. In an alternative implementation, the grating of the encoder is positioned on an outside circumference of the hub, and the sensor of the encoder is positioned proximate to the grating of the encoder.

In another aspect, the rotation motor control mechanisms also includes a motor for rotating the media hub, and the motor has a motor housing which forms the media hub. In another embodiment, the rotation motor control mechanism of the recording device includes a media hub on which the media is placed and rotated thereon and a motor for rotating a shaft of the media hub. In this embodiment, the grating of the encoder is positioned on the shaft of the hub and the sensor of the encoder is positioned proximate to the grating of the encoder. In one aspect, the grating forms a grating wheel attached to the shaft of the media hub. In a further implementation, the motor is enclosed by a housing. In one aspect, the grating wheel and the sensor are contained within the motor housing. In another aspect, the grating wheel and the sensor are contained outside the motor housing. In another embodiment, the encoder is operable to produce a count that corresponds to a specific angular position of the rotating media. In a further aspect, the encoder is operable to reset the count that corresponds to a specific angular position of the rotating media when the sensor senses a zero mark of the grating.

In an alternative embodiment, the invention pertains to a method of interfacing with a media recording device to thereby print onto a rotating media. The recording device includes a rotation motor control mechanism for rotating the media and an interface system for allowing control of the rotation motor control mechanism. A substantially instantaneous angular position of the rotating media is sensed. The sensing is independent from the recording device. The interface system of the recording device is interfaced with to thereby control the rotation motor control mechanism, and ink is dispensed onto the rotating media based on the received angular position. In one aspect, the sensed angular position is not sent to the recording device. In another aspect, the sensed angular position is not obtained from an encoder of the recording device. In a specific implementation, a count that corresponds to a specific angular position of the rotating media is produced. In a further aspect, the count that corresponds to a specific angular position of the rotating media is reset each time the rotating media completes a full revolution.

These and other features and advantages of the present invention will be presented in more detail in the following specification of the invention and the accompanying figures which illustrate by way of example the principles of the invention.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF SPECIFIC EMBODIMENTS

The present invention will now be described in detail with reference to a few preferred embodiments as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

For the scope of this invention, the terms "CD" and "media" are intended to mean all varieties of optical recording media discs, such as CD-R, CD-RW, DVD-R, DVD+R, DVD-RAM, DVD-RW, DVD+RW and the like.

The angular position retrieval mechanisms described herein may be integrated within any suitable radial printer. Several embodiments of radial printers are further described in above referenced U.S. Pat. No. 6,264,295, entitled RADIAL PRINTING SYSTEM AND METHODS by George L. Bradshaw et al, issued Jul. 24, 2001, and co-pending U.S. patent application, having application Ser. No. 09/872,345, entitled LOW PROFILE CAM-ACTUATED TRACKING INK HEAD CARTRIDGE WITH INTEGRATED SERVICE-STATION, by Randy Q. Jones et al., filed Jun. 1, 2001. The angular position retrieval mechanisms may be combined with other angular position techniques further elaborated in co-pending U.S. Patent Application, having application Ser. No. 09/815,064, filed Mar. 21, 2001, entitled METHOD FOR PROVIDING ANGULAR POSITION INFORMATION FOR A RADIAL PRINTING SYSTEM, by Youngberg et al., and co-pending U.S. patent application, having application Ser. No. 09/872,345, entitled LOW PROFILE CAM-ACTUATED TRACKING INK HEAD CARTRIDGE WITH INTEGRATED SERVICE-STATION, by Randy Q. Jones et al., filed Jun. 1, 2001. These referenced applications are incorporated herein by reference in their entirety for all purposes.

Figure 1:
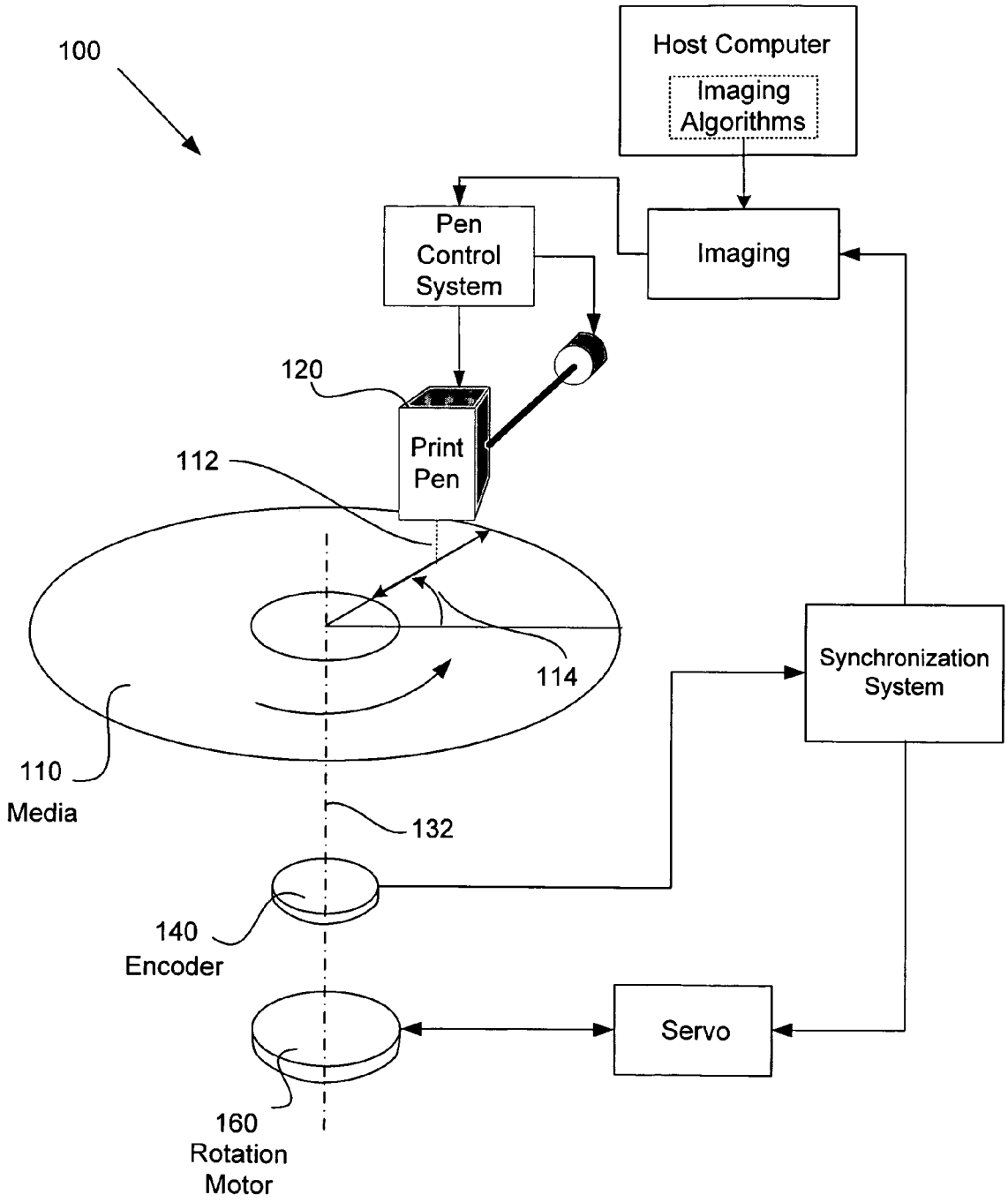
FIG. 1 represents a portion of a radial printing system with media, ink pen, rotation motor and encoder to provide instantaneous angular position information in accordance with various embodiments of the present invention.

FIG. 1 illustrates a radial printing device 100 with an encoder 140 mounted directly on the rotation axis 132 of the CD rotation motor 160. The mechanisms described herein reduce or minimize the number of parts involved to obtain the instantaneous position of the circular media by incorporating an encoding device 140, directly into the motor 160 or spindle used to rotate the media 110.

Figure 10:
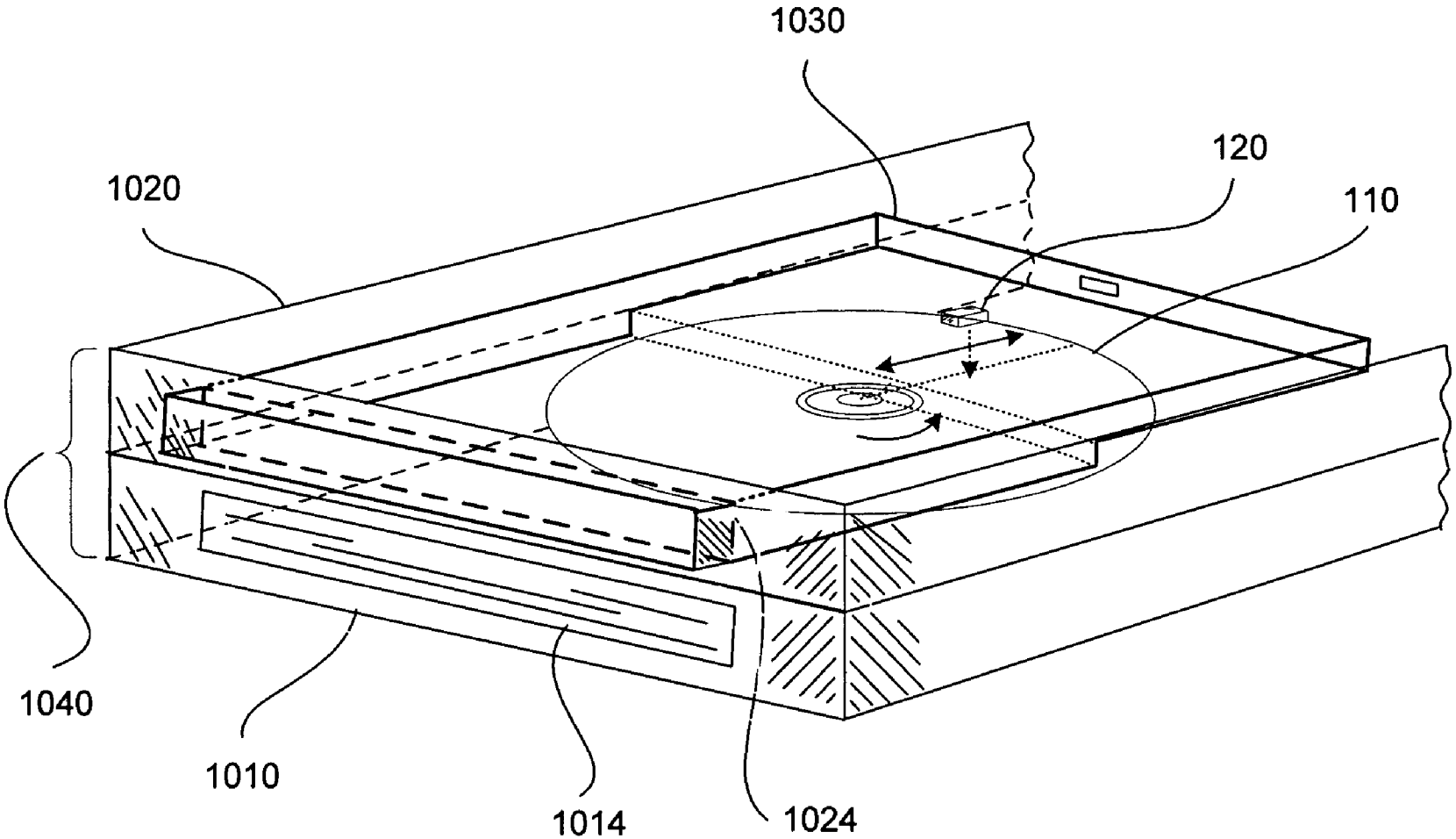
FIG. 10 shows as a combined slimline CD-RW drive mounted under a low-profile printer in accordance with one embodiment of the present invention.

Additional challenges exist with physical limitations and interactions of the devices employed, such as in an embodiment in which the radial printer is combined or otherwise integrated with an OEM CD-R recorder device, such as illustrated in Jones et al, referenced above and shown in FIG. 10. FIG. 10 shows as a combined slimline CD-R or CD-RW drive 1010 mounted under a low-profile printer 1020, the combined height 1040 of which is selected so that it can be mounted in a standard half-height computer bay of approximately 1.65 inches. The print pen 120 is integrally incorporated into a low-profile cartridge 1030, which slides into slot 1024 on the front of the radial printer 1020. CD-RW drive 1010 has tray 1014 opening underneath cartridge 1030 slot 1024 also on the front of the radial printer 1020. Given this vertical space limitation 1040, encoders and motors incorporated into a slimline drives are preferably designed as to fit into a vertically low-profile size slimline device of less than 0.55 inches (approximately 14 mm).

The CD-R or CD-RW device may either shares angular position information with the radial printer, or the radial printer device independently obtains angular position information through a separate angular position mechanism from the CD-R device's angular position mechanism, to ensure the accurate placement of ink objects onto the spinning circular media.

Relying upon the CD-R device to provide angular position information may require modifying the CD-R device or making special production runs for radial printing, which usually incurs additional costs during manufacturing. Conversely, using a separate angular position mechanism frees the radial printing design from these manufacturing burdens and the inherent design restraints of the CD-R device. For example, the native wobble signal from CD-R drives of 22 kHz at 1X CD speed results in a limit of the number of angular positions to about 7000 counts per revolution. To print radially at 600 DPI, approximately 10,000 count per revolutions are required to accurately print with minimal annular distortion. Thus, to radially print at 600 DPI or higher resolutions, there is a need to have accurate angular position information obtained for a radial printing device integrated within an OEM CD-R drive.

Figure 8:
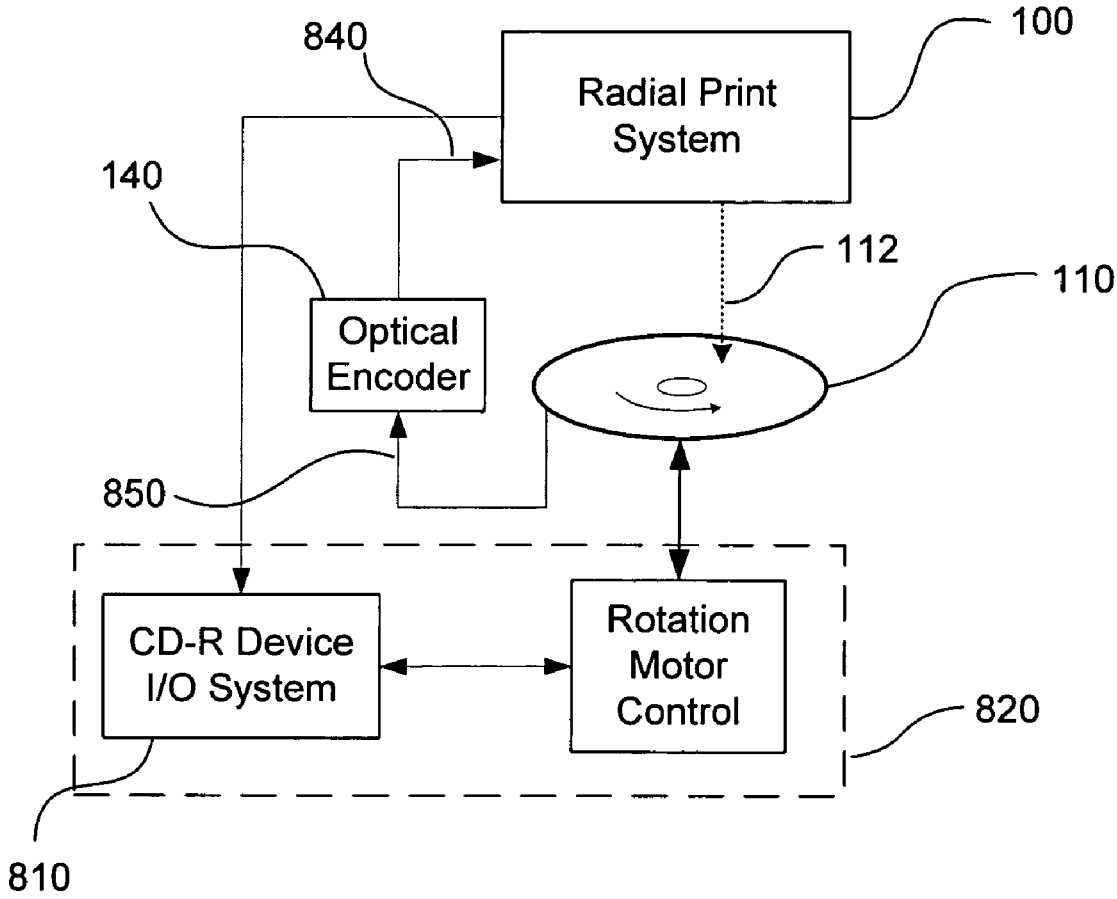
FIG. 8 is a block diagram illustrating how to use encoder signals in radial printing in accordance with one embodiment of the present invention.

FIG. 8 illustrates a general process of using an independent encoder 140 to synchronously print with the operation of a CD-R device 820 in accordance with one embodiment of the present invention. A radial print system 100, commands the CD-R device 820 to spin the media 110, as the independent encoder 140 senses angular rotation information 850 from the spinning media 110. The angular rotation information 850 is sent 840 to the radial print system 100, which in turn prints ink 112 to the media 110.

In one embodiment, the encoder 140 includes a sensor 280 and an accompanying grating 260, as represented as enlargements details in FIGS. 2*b*, 3*b*, 4*b*, 5*b*, 6*b*, and 7*b* as implemented within a plurality of radial print system embodiments. The sensor 280 of encoder 140 outputs electrical signals corresponding to the movement of a grating 260 passing nearby. The grating 260 is coupled with the shaft 132 connected ultimately to the rotating media 110. In a CD-R or CD-RW device, the grating may be mounted directly on the shaft 132 of the motor 160. The sensor 280 and grating 260 for this type of application can be of an optical technology design, being a matched pair. The grating may be formed from any suitable material, such as chrome-plated glass, steel, rigid plastic or Mylar mounted on rigid backing material, such as with an interference grating preferred in the present invention. For example, one encoder technology that looks promising is disclosed in U.S. Pat. No. 5,486,923, entitled APPARATUS FOR DETECTING RELATIVE MOVEMENT WHEREIN A DETECTING MEANS IS POSITIONED IN THE REGION OF NATURAL INTERFERENCE by Donald K. Mitchell et al, issued Jan. 23, 1996, which patent is incorporated herein by reference in its entirety. However, the present invention is not limited to using optical technology and could also use magnetic Hall-effect devices, mechanical commutator switches, or inductive transformer resolvers; however, the later two technologies are usually too slow or too massive to be applied to the present invention.

The encoder's sensor 280 may alternatively be mounted outside of the motor 160 near the top or bottom of the shaft 132 attached to the rotating media 110. The encoder's grating 260 may be alternately mounted on the shaft 132, either above the media 110, below the media 110 (above or below the motor 160).

Figure 2A:
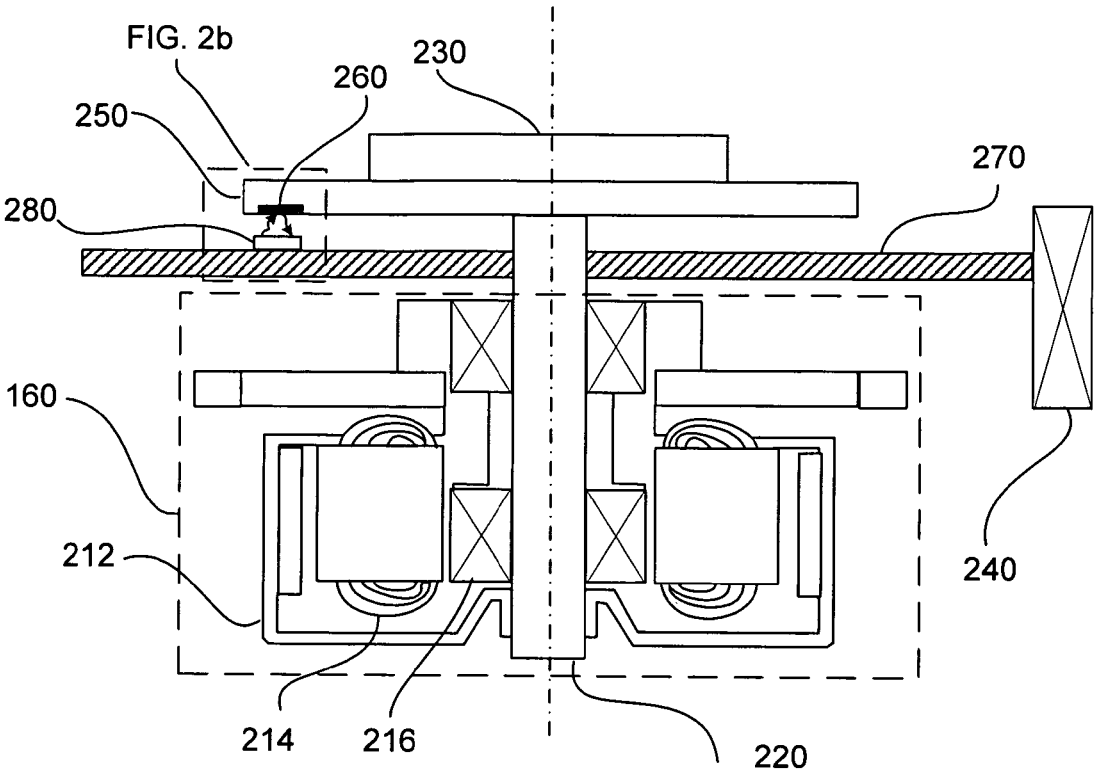
FIGS. 2*a* and 2*b* represent a first embodiment of the invention with a top-mounted encoder located on the bottom side of the CD disc hub.

In one embodiment of the present invention, as shown in FIG. 2*a*, the encoder 140 is mounted on top of the motor 160, pointed at the grating 260 located on the bottom side of the CD disc hub 250. CD motor 160 has shaft 220 that extends above the motor housing and into CD hub 250 with CD clasp 230 for attaching, positioning and holding the CD media 110 (not shown in FIG. 2*a*). Motor 160 may be any suitable design, such as an armature 214, bearings 216, shaft, 220 and housing 220. However, any other suitable design that meets the physical tolerances and space limitations related to mounting the encoder 140 in close proximity thereof may be used. That is, there may be physical limitations for the overall integrated print system and CD-R system so that it may fit within a standard sized computer bay slot. In this particular embodiment, sensor 280 is mounted on printed circuit board 270 such that the sensor can read data from the grating 260 mounted on the underside of the CD disc hub 250. As the CD spins, the grating 260 spins concurrently and synchronously, generating signal 284 for sensor 280 to produce counts. This embodiment may work best when there is a minimum vertical space between the motor 160 and the hub 250 to accommodate the printed circuit board, and when minimum space exists below the motor so that the overall system may be inserted within a standard sized computer bay slot.

Figure 2B:
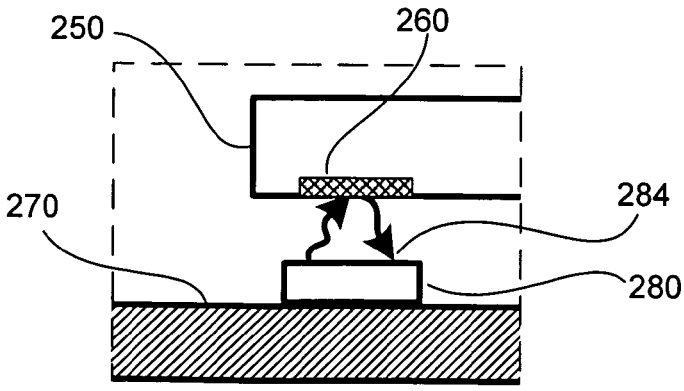

FIG. 2*b* is an enlargement of an encoder of the first embodiment. The sensor 260 receives optical pulses from the grating 280, and interpolates them as counts. To radially print, the grating 280 in radial printer 100 must have sufficient primary resolution to effect printing, typically about 17 counts per dot per inch (DPI) printed at the outer circumference of a CD, or 20,480 counts for about 1200 DPI. A typical encoder that performs with this precision is the M-1000 product from MicroE Systems, Natick, Mass.

Figure 9:
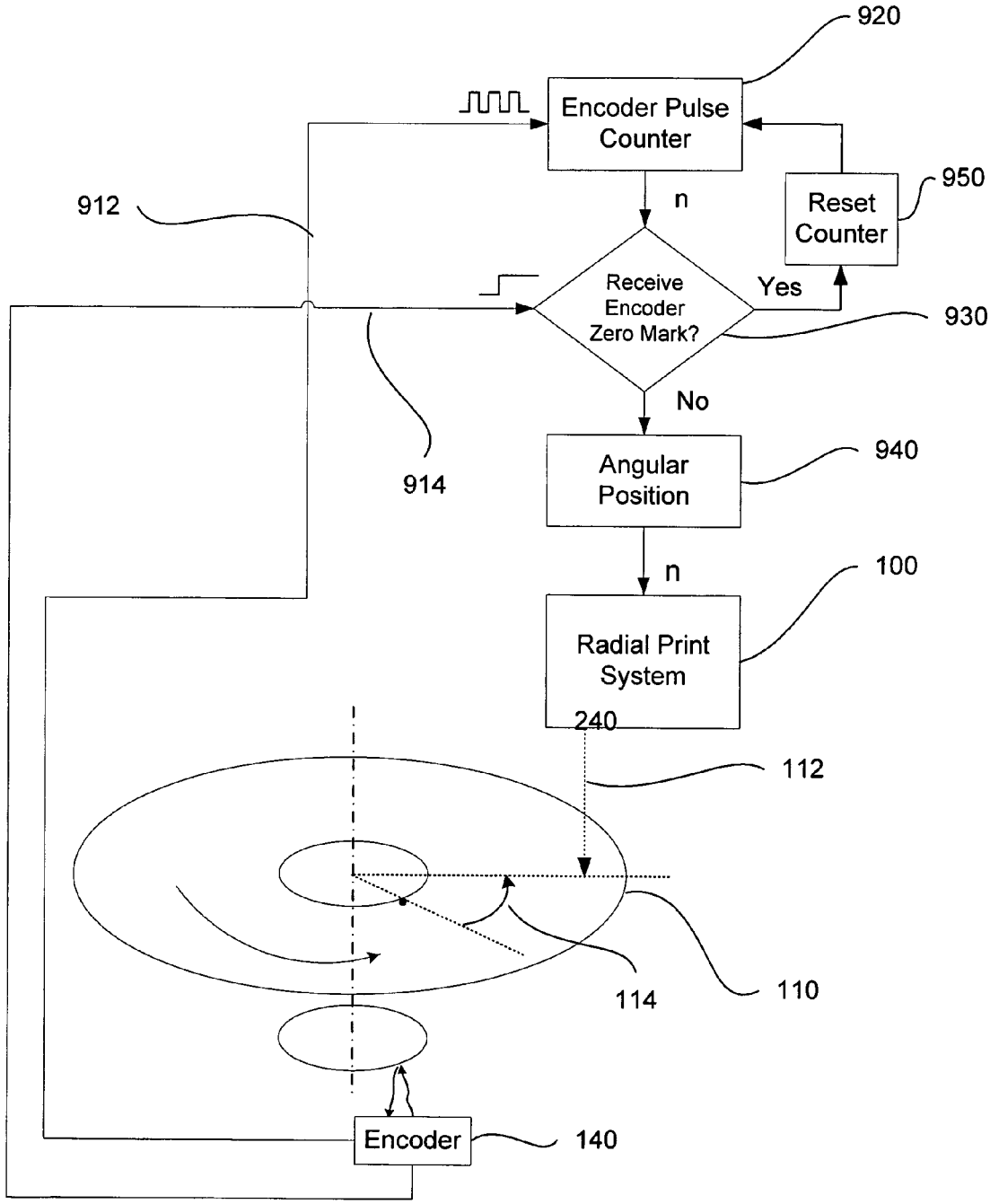
FIG. 9 is a flow chart and block diagram illustrating a procedure for retrieving angular position information from an encoder mounted with a CD-R device in a radial printer in accordance with one embodiment of the present invention.

FIG. 9 is a flow chart and block diagram illustrating mechanisms for retrieving and determining specific angular position counts to thus affect radial printing in accordance with one embodiment of the present invention. Encoder 140 receives instantaneous angular position 114 information from spinning media 110 and sends counts 912 to the encoder pulse counter 920, which accumulates counts per rotation. Once each rotation, encoder 140 also receives a zero mark pulse 914. Operation 930 determines whether a zero mark has been received. When a zero mark is received, the pulse count is reset for the next revolution of counting in operation 950. Otherwise, the current count is sent as the angular position 940 to the radial print system 100. The radial print system 100 then prints ink 112 onto the media 110 at the appropriate angular position 114 based on the received angular position. This technique ensures accurate angular position placement of printed ink objects onto the rotating media 110, given use of precision encoder devices such as the MicroE device disclosed above.

The encoder may include mechanisms for sensing and counting pulses from a grating and sensing a zero mark integrated within a single package of hardware and/or software or be individually packaged into separate hardware or software components. Additionally, the zero mark may form part of the grating or be positioned physically separate from the grating. The zero mark may be located in any suitable position that is coupled to the rotations of the media (e.g., on the hub or shaft). The encoder may include a single sensor for sensing both the grating pulses and the zero mark or contain two sensors for independently sensing the grating pulses and zero mark.

Other embodiments of the present invention show a variety of placement for the encoder's sensor and grating in and around the proximity of a CD motor.

Figure 3A:
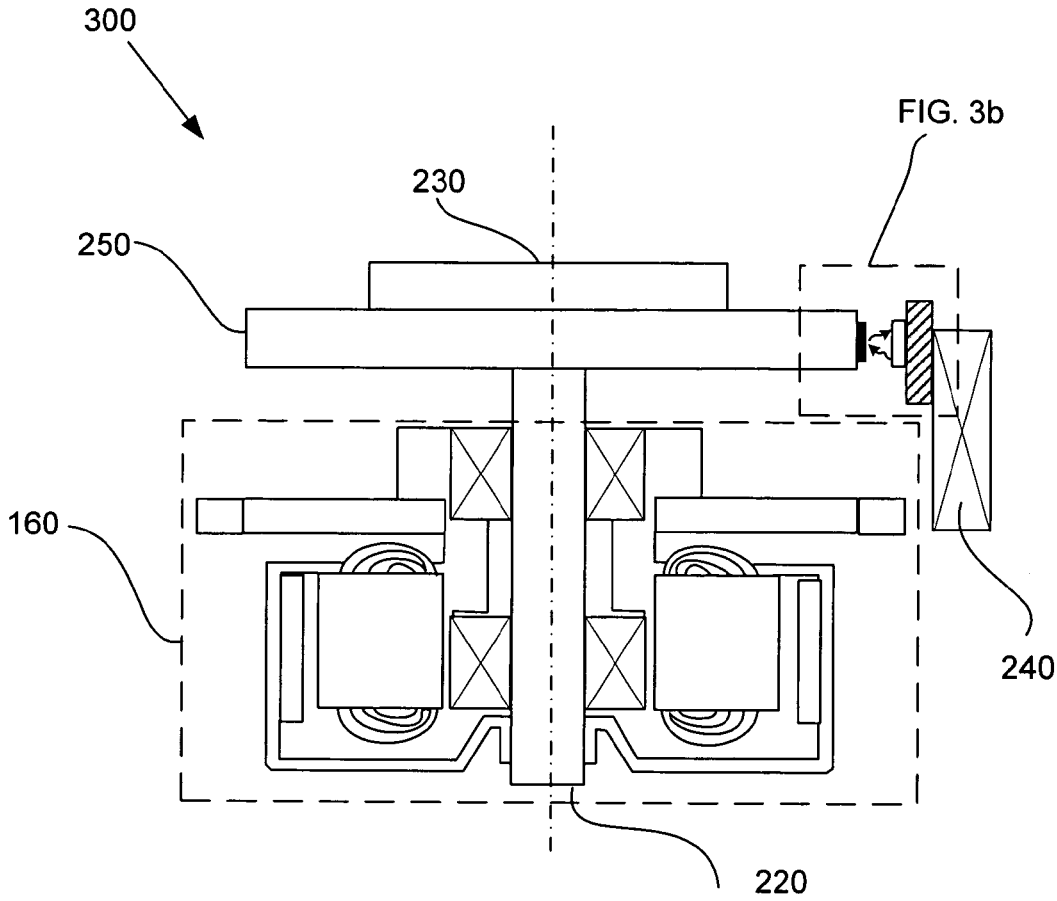
FIGS. 3*a* and 3*b* represent a second embodiment of the invention with a top-mounted encoder located on the cylindrical side of the CD disc hub.
Figure 3B:
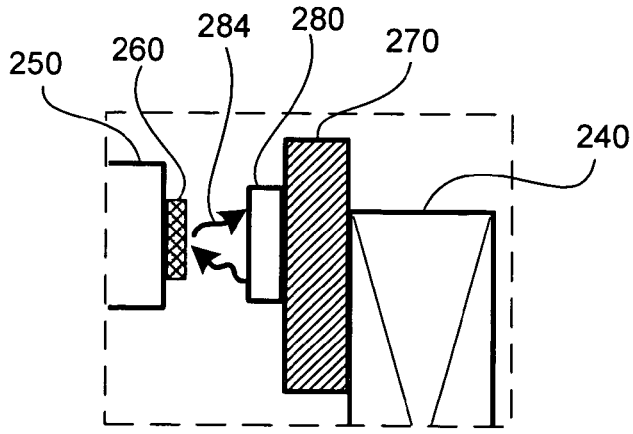

In another embodiment of the present invention, as shown in FIGS. 3*a* and 3*b*, encoder 140 is mounted on top of the motor 160, adjacent to CD hub 250, such that grating 260 is mounted to the outside circumference of the hub 250 and sensor 280 is attached to a mounting bracket 240 on the device chassis. As the CD spins, the grating 260 spins concurrently and synchronously, generating signal 284 for sensor 280 to product counts. This embodiment may work best when there is minimum vertical space between the motor 160 and the hub 250, when minimum space exists below the motor, and when the hub is precisely fashioned such that no gaps or overlaps result in the grating when attached to the outer cylindrical circumference of the hub 250. This minimum spacing preferably allows the system 300 to fit within a standard sized computer bay slot.

In still another embodiment of the present invention shown in FIGS. 4*a* and 4*b*, encoder 140 is mounted below the motor 160 on the shaft 220 extending out from the bottom of the CD motor. PC board 270 with sensor 280 is mounted immediately below the motor so as to point toward the grating wheel 250, mounted on the bottom of shaft 220. As the CD spins, the grating 260 spins concurrently and synchronously, generating signal 284 for sensor 280 to produce counts. This embodiment may work best when there is minimum vertical space on the top of the motor between the motor 160 and the hub 250, but ample space below the motor 160. For example, the present embodiment may be designed into a radial printer that sits adjacent to a desktop computer, in which case the combined motor 160 housing 212 with encoder 140 assembly can extend below the CD housing 410 and into the radial printer's base.

Figure 4A:
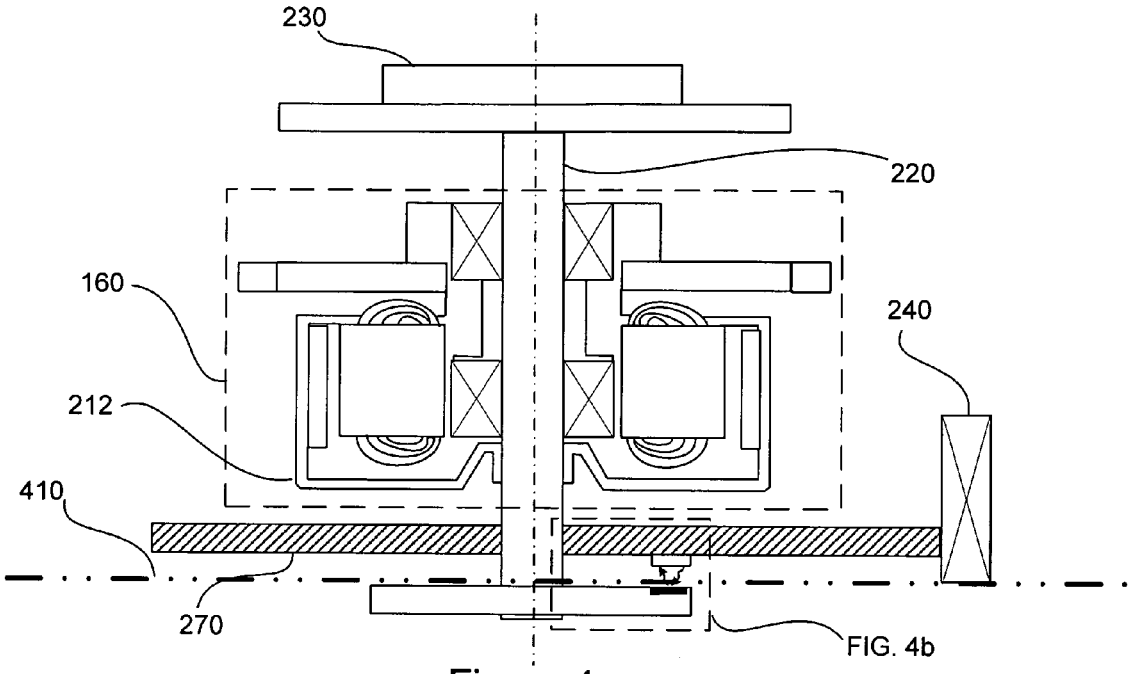
FIGS. 4*a* and 4*b* represent a third embodiment of the invention with a bottom-mounted encoder located on the rotation shaft extending from the bottom of the CD motor.
Figure 4B:
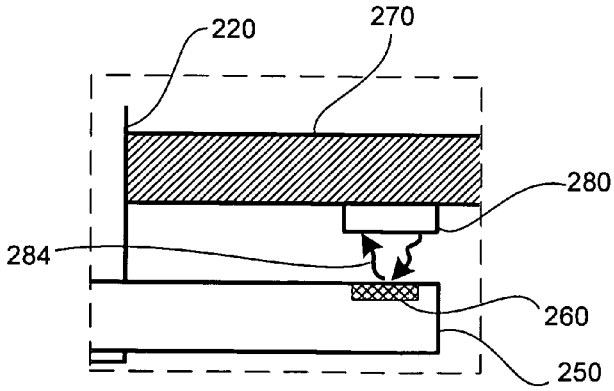
Figure 5A:
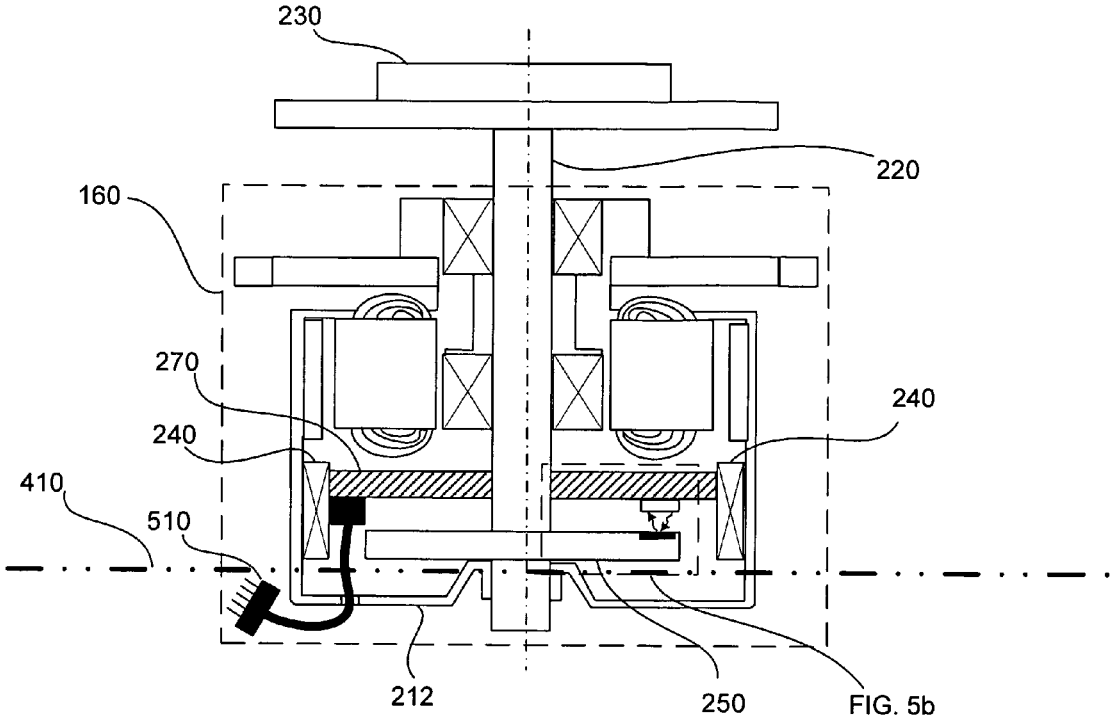
FIGS. 5*a* and 5*b* represent a fourth embodiment of the invention with an encoder mounted on the rotation shaft inside of the bottom of the CD motor.
Figure 5B:
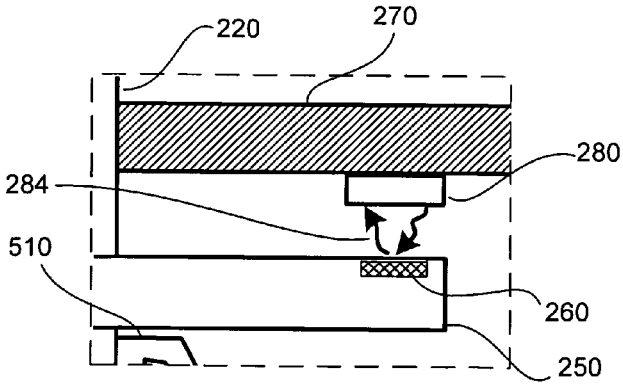

In yet another embodiment of the present invention shown in FIGS. 5*a* and 5*b*, the encoder 140 sensor 280 and grating 260 technologies are similar mounted as shown in FIGS. 4*a* and 4*b* above, but are instead located inside of the bottom of the CD motor 160 on the rotation shaft 132. Cable 510 powers and connects control and logic signals to the encoder 140 within the motor 160 housing 212. As the CD spins, the grating 260 spins concurrently and synchronously, generating signal 284 for sensor 280 to produce counts. This embodiment may work best when there is minimum vertical space on the top of the motor between the motor 160 and the hub 250, but ample space below the motor 160. For example, similar to the previous embodiment, the present embodiment may be designed into a radial printer that sits adjacent to a desktop computer, in which case the combined motor 160 housing 212 with the integrated encoder 140 assembly can extend below the CD housing 410 and into the radial printer's base. Having the encoder 140 completely built inside the motor, permits a device with a CD motor and a position encoder to be implemented within a combined radial printing CD-recorder device.

Figure 6A:
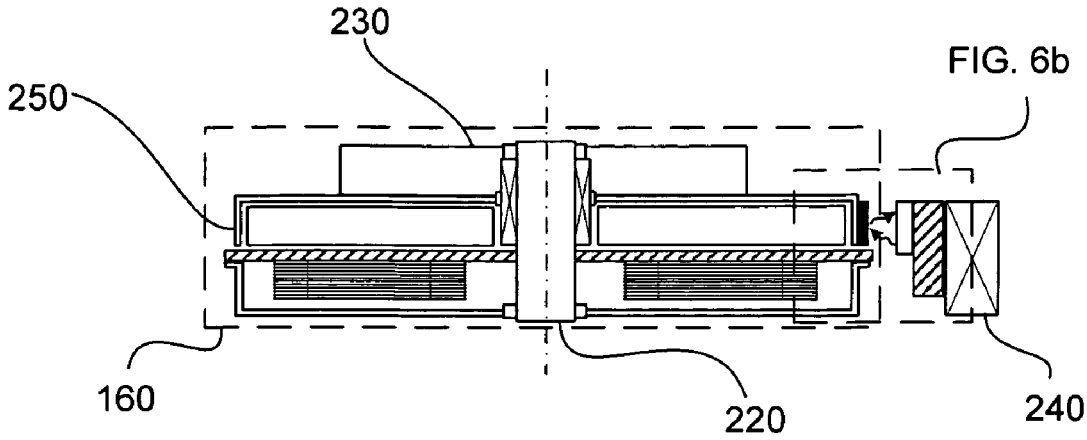
FIGS. 6*a* and 6*b* represent a fifth embodiment of the invention with an encoder mounted horizontally located on the cylindrical outside of the slimline CD integrated disc hub and motor assembly.
Figure 6B:
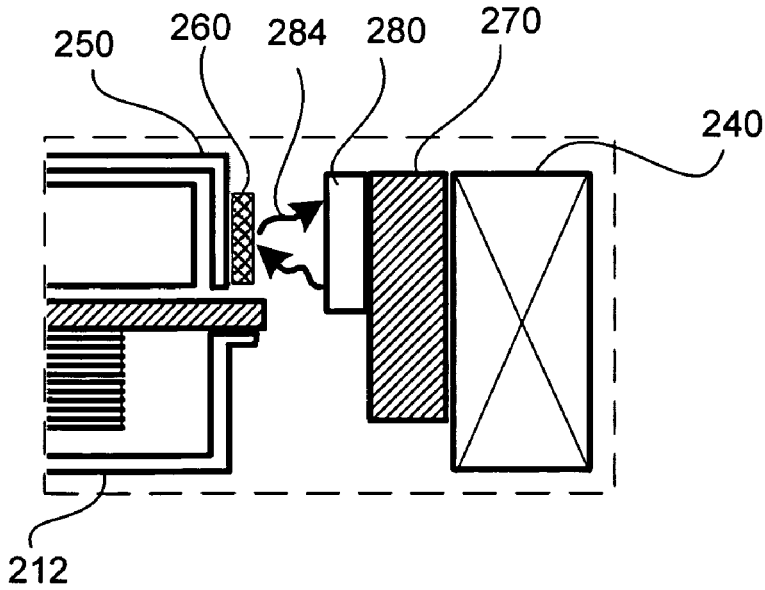

In another embodiment of the present invention as shown in FIGS. 6*a* and 6*b*, encoder 140 is shown adapted to a slimline CD motor 160, with motor rotor housing 250 also functioning in this compact form factor as the CD hub (250). Since rotor/hub 250 rotates with the media 110, grating 260 is mounted to the outside circumference of the hub 250 and sensor 280 is attached to a mounting bracket 240 on the device chassis. As the CD spins, the grating 260 spins concurrently and synchronously, generating signal 284 for sensor 280 to produce counts. This embodiment may work best for combining form factor slimline CDs with radial printers, when there is minimum vertical space overall, and when the hub is precisely fashioned such that no gaps or overlaps result in the grating when attached to the outer cylindrical circumference of the hub 250. Such an application is described above with reference to FIG. 10 depicting a low-profile combined CD-RW and radial printer, wherein the overall allowable height of the combined CD motor 160 and encoder 140 preferably fits into a slimline height of approximately 0.55 inches (about 14 mm). Of course, the allowable height may change to meet future height requirements of new standard sized computer bays and slimline components.

Figure 7A:
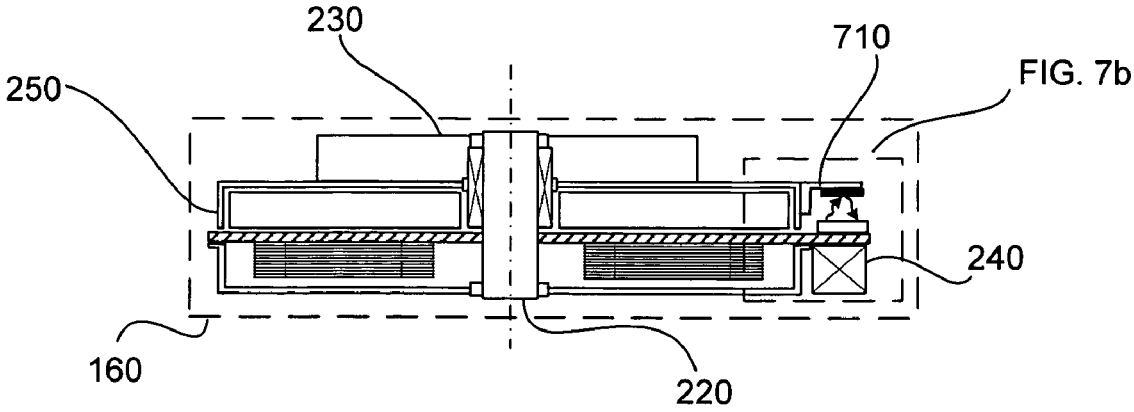
FIGS. 7*a* and 7*b* represent a sixth embodiment of the invention with an encoder mounted vertically to a flange attached to and extending horizontally from the cylindrical outside of the slimline CD integrated disc hub and motor assembly.
Figure 7B:
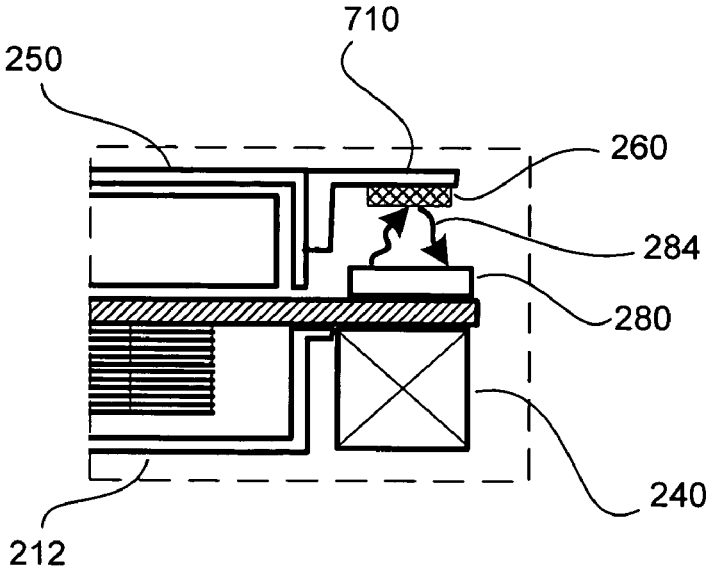

In still another embodiment of the present invention, as shown in FIGS. 7*a* and 7*b*, encoder 140 is also shown adapted to a slimline CD motor 160, with motor rotor housing 250 also functioning in this compact form factor as the CD hub (250). As shown in FIG. 7*b*, rotor/hub 250 rotates with the media 110, grating 260 is mounted to the outside circumference, vertically to a flange 710 attached to and extending horizontally from the cylindrical outside of the slimline CD, of the hub 250 and sensor 280 is attached to a mounting bracket 240 on the device chassis. As the CD spins, the grating 260 spins concurrently and synchronously, generating signal 284 for sensor 280 to produce counts. This embodiment may work best for combining form factor slimline CDs with radial printers, when there is minimum vertical space overall, and where there is adequate but marginal space for mounting the encoder 140 assembly and flange 710. Similar to the prior embodiment, such an application was previously described with respect to FIG. 10 depicting a low-profile combined CD-RW and radial printer, wherein the overall allowable height of the combined CD motor 160 and encoder 140 preferably fits into a slimline height of approximately 0.55 inches (about 14 mm).

Other embodiments, using similar mechanisms for obtaining accurate angular position information for use in radial printing are similarly contemplated. While this invention has been described in terms of several preferred embodiments, there are alterations, permutations, and equivalents, which fall within the scope of this invention. It is therefore intended that the following appended claims be interpreted as including all such alterations, permutations, and equivalents as fall within the true spirit and scope of the present invention.

What is claimed is:

1. An apparatus for interfacing with a media recording device to thereby print onto a rotating media, wherein the recording device includes a rotation motor control mechanism for rotating the media and an interface system for allowing control of the rotation motor control mechanism, the apparatus comprising:

an encoder for sensing a substantially instantaneous angular position of the rotating media, wherein the encoder comprising a grating having a readable pattern and positioned to rotate with the media and a sensor positioned to sense the pattern of the grating to thereby obtain an angular position of the rotating media, wherein neither the grating nor the sensor is physically positioned on the rotating media; and a radial print system for receiving the angular position from the encoder, interfacing with the interface system of the recording device to thereby control the rotation motor control mechanism of the recording device to thereby rotate the media, and dispensing ink onto the rotating media based on the received angular position.

2. An apparatus as recited in claim 1, wherein the angular position sensed by the encoder is not sent to the recording device.

3. An apparatus as recited in claim 1, wherein the angular position sensed by the encoder is not obtained from an encoder of the recording device.

4. An apparatus as recited in claim 1, wherein the encoder employs an optical or magnetic sensing technology.

5. An apparatus as recited in claim 1, wherein the rotation motor control mechanism of the recording device includes a media hub on which the media is placed and rotated thereon, the grating of the encoder being positioned on a side of the hub which is opposite a side on which the media is placed and sensor of the encoder being positioned proximate to the grating of the encoder.

6. An apparatus as recited in claim 1, wherein the rotation motor control mechanism of the recording device includes a media hub on which the media is placed and rotated thereon, the grating of the encoder being positioned on an outside circumference of the hub and the sensor of the encoder being positioned proximate to the grating of the encoder.

7. An apparatus as recited in claim 6, wherein the rotation motor control mechanisms also comprises a motor for rotating the media hub, the motor having a motor housing which forms the media hub.

8. An apparatus as recited in claim 1, wherein the rotation motor control mechanism of the recording device includes a media hub on which the media is placed and rotated thereon and a motor for rotating a shaft of the media hub, the grating of the encoder being positioned on the shaft of the hub and the sensor of the encoder being positioned proximate to the grating of the encoder.

9. An apparatus as recited in claim 8, wherein the grating forms a grating wheel attached to the shaft of the media hub.

10. An apparatus as recited in claim 9, wherein the motor is enclosed by a housing.

11. An apparatus as recited in claim 10, wherein the grating wheel and the sensor are contained within the motor housing.

12. An apparatus as recited in claim 10, wherein the grating wheel and the sensor are contained outside the motor housing.

13. An apparatus as recited in claim 1, wherein the encoder is operable to produce a count that corresponds to a specific angular position of the rotating media.

14. An apparatus as recited in claim 13, wherein the encoder is operable to reset the count that corresponds to a specific angular position of the rotating media when the sensor senses a zero mark of the grating.

15. An apparatus as recited in claim 1, wherein the encoder is configured with the radial print system to synchronously print onto the rotating media.

16. A method of interfacing with a media recording device to thereby print onto a rotating media, wherein the recording device includes a rotation motor control mechanism for rotating the media and an interface system for allowing control of the rotation motor control mechanism, the method comprising:

sensing with an encoder a substantially instantaneous angular position of the rotating media, wherein the encoder comprising a grating having a readable pattern and positioned to rotate with the media and a sensor positioned to sense the pattern of the grating to thereby obtain an angular position of the rotating media, wherein neither the grating nor the sensor is physically positioned on the rotating media;

interfacing with the interface system of the recording device to thereby control the rotation motor control mechanism of the recording device to thereby rotate the media; and dispensing ink radially onto the rotating media based on the received angular position.

17. A method as recited in claim 16, wherein the sensed angular position is not sent to the recording device.

18. A method as recited in claim 16, wherein the sensed angular position is not obtained from an encoder of the recording device.

19. An apparatus as recited in claim 16, further comprising producing a count that corresponds to a specific angular position of the rotating media.

20. An apparatus as recited in claim 16, further comprising resetting the count that corresponds to a specific angular position of the rotating media each time the rotating media completes a full revolution.

21. A method as recited in claim 16, wherein dispensing ink radially onto the rotating media is synchronized based on the received angular position.

* * * * *